US011828205B2

(12) United States Patent
Patil

(10) Patent No.: US 11,828,205 B2
(45) Date of Patent: Nov. 28, 2023

(54) LATCH ASSEMBLY AND COMPACT ROCKER ARM ASSEMBLY

(71) Applicant: Eaton Intelligent Power Limited, Dublin (IE)

(72) Inventor: Santosh Patil, Pune (IN)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/758,640

(22) PCT Filed: Jan. 15, 2021

(86) PCT No.: PCT/EP2021/025009
§ 371 (c)(1),
(2) Date: Jul. 12, 2022

(87) PCT Pub. No.: WO2021/144148
PCT Pub. Date: Jul. 22, 2021

(65) Prior Publication Data

US 2023/0042443 A1 Feb. 9, 2023

(30) Foreign Application Priority Data

Jan. 16, 2020 (IN) ..... 202011002040

(51) Int. Cl.
*F01L 1/18* (2006.01)
*F01L 13/00* (2006.01)
*F01L 1/46* (2006.01)

(52) U.S. Cl.
CPC ..... *F01L 1/181* (2013.01); *F01L 1/46* (2013.01); *F01L 13/0005* (2013.01); *F01L 2001/186* (2013.01); *F01L 2013/001* (2013.01)

(58) Field of Classification Search
CPC ..... F01L 1/181; F01L 2001/186; F01L 1/46; F01L 13/0005; F01L 2013/001
(Continued)

(56) References Cited

U.S. PATENT DOCUMENTS 5,544,626 A * 8/1996 Diggs ..... F01L 1/185 123/90.16
7,121,241 B1 10/2006 Genise et al.
(Continued)

FOREIGN PATENT DOCUMENTS

CN 101365865 A 2/2009
CN 203640793 U * 6/2014
(Continued)

OTHER PUBLICATIONS

International Search Report and Written Opinion for PCT/EP2021/025009; dated Apr. 30, 2021; pp. 1-12.
(Continued)

*Primary Examiner* — Jorge L Leon, Jr.
(74) *Attorney, Agent, or Firm* — Baker Botts L.L.P.

(57) ABSTRACT

A latch assembly comprises a latch pin configured to reciprocate in a latch bore. The latch pin comprises a main body comprising a first plug end, a second plug end, and a clearance between the first plug end and the second plug end. The latch pin is configured to selectively move in the latch bore. A rocker arm assembly can comprise the latch assembly. An outer arm can be configured to rotate about a rocker shaft and comprise the latch bore. An inner arm can at least be partially disposed within the outer arm and configured to rotate. When the latch pin is in the activated position, the inner arm is configured to transfer force to the outer arm via the latch pin. When the latch pin is in the deactivated position, the inner arm is configured to move in the clearance and in the lost motion gap.

14 Claims, 8 Drawing Sheets

(58) Field of Classification Search
USPC ..... 123/90.39, 90.44
See application file for complete search history.

(56) References Cited

U.S. PATENT DOCUMENTS

| | | | | |
|---|---|---|---|---|
| 7,546,822 | B2 | 6/2009 | Murphy et al. | |
| 10,533,463 | B1 | 1/2020 | Mariuz et al. | |
| 10,781,729 | B1 * | 9/2020 | Foster | F01L 13/0021 |
| 2002/0124820 | A1 * | 9/2002 | Kreuter | F01L 13/0005 123/90.16 |
| 2007/0193543 | A1 * | 8/2007 | Best | F01L 13/0005 123/90.39 |
| 2017/0284313 | A1 * | 10/2017 | Shewell | F01L 1/2416 |
| 2019/0316494 | A1 * | 10/2019 | Mariuz | F01L 13/0005 |

FOREIGN PATENT DOCUMENTS

| | | | |
|---|---|---|---|
| CN | 204041146 | U | 12/2014 |
| CN | 109923286 | A | 6/2019 |
| CN | 110573704 | A | 12/2019 |
| WO | WO 2018217536 | A2 | 11/2018 |
| WO | 2020240479 | A1 | 12/2020 |

OTHER PUBLICATIONS

CN OA for Chinese Application No. 202180007535X, dated Mar. 30, 2023.
CN NOA for Chinese Application No. 202180007535X, 5 pages.

* cited by examiner

LATCH ASSEMBLY AND COMPACT ROCKER ARM ASSEMBLY

CROSS-REFERENCE TO RELATED APPLICATIONS

This is a United States § 371 National Stage Application of PCT/EP2021/025009 filed Jan. 15, 2021 and application claims the benefit of Indian provisional application 202011002040 filed Jan. 16, 2020, the contents of which are incorporated herein by reference thereto.

FIELD

The present disclosure relates generally to a rocker arm assembly for use in a valve train assembly and, more particularly, to a Type III valvetrain cylinder deactivation (CDA) system for providing secondary valve lift such as engine braking. A latch assembly is also provided.

BACKGROUND

Some internal combustion engines can utilize rocker arms to transfer rotational motion of cams to linear motion appropriate for opening and closing engine valves. Deactivating rocker arms incorporate mechanisms that allow for selective activation and deactivation of the rocker arm. In a deactivated state, the rocker arm may exhibit lost motion movement. However, conventional valve train carrier assemblies may typically be concerned with contact stress issues, high stiffness issues, high cycle fatigue requirements, and compact packaging requirements. Accordingly, while conventional valve train carrier assemblies with deactivating rocker arms work well for their intended purpose, there remains a need for improvement in the relative art.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

In one aspect, a rocker arm assembly for a Type III valvetrain arranged for cooperation with a cylinder head is provided. The rocker arm assembly includes a rocker arm having an outer arm configured to rotate about a rocker shaft, an inner arm at least partially disposed within the outer arm and configured to rotate about a rocker shaft, and a latch pin movable between an activated position and a deactivated position. In the activated position, rotation of the inner arm about the rocker shaft is transferred to the outer arm via the latch pin. In the deactivated position, rotation of the inner arm about the rocker shaft is not transferred to the outer arm.

A latch assembly for a switchable rocker arm comprises a latch bore comprising a first bore end, a second bore end, and a lost motion gap. A latch pin is configured to reciprocate in the latch bore. The latch pin comprises a main body comprising a first plug end in the first bore end, a second plug end in the second bore end, and a clearance between the first plug end and the second plug end. The latch pin is configured to selectively move in the latch bore between an activated position and a deactivated position.

A rocker arm assembly can comprise the latch assembly. An outer arm can be configured to rotate about a rocker shaft and can comprise the latch bore. An inner arm can at least be partially disposed within the outer arm and configured to rotate. When the latch pin is in the activated position, the inner arm is configured to transfer force to the outer arm via the latch pin. When the latch pin is in the deactivated position, the inner arm is configured to move in the clearance and in the lost motion gap.

BRIEF DESCRIPTION OF THE DRAWINGS

The present disclosure will become more fully understood from the detailed description and the accompanying drawings, wherein.

DETAILED DESCRIPTION

As an operational example of a rocker arm assembly, described herein is a heavy duty Type III rocker arm assembly with cylinder deactivation (CDA) with high stiffness and low mass moment of inertia. In such a valvetrain, CDA is achieved through a round latch pin engagement between two rocker arm bodies to transfer load and disengage in lost motion. An inner arm, an outer arm, and a latch pin are designed to reduce stress, reduce deformations, and yield high fatigue life. The inner and outer arms are designed to resist bending shear and tensile stresses, while the latch pin is designed and arranged such that contact does not create sharp or singular contact/Hertzian stresses, which can lead to wear and tear and prevent intended functionality to transfer full lift or no lift. In another aspect, a latch assembly is disclosed for use in this and other rocker arm assemblies. The latch assembly is particularly suited for "scissor" type III rocker arm assemblies and other switchable rocker arm assemblies such as switching roller finger followers for type II valvetrains.

Figure 1:
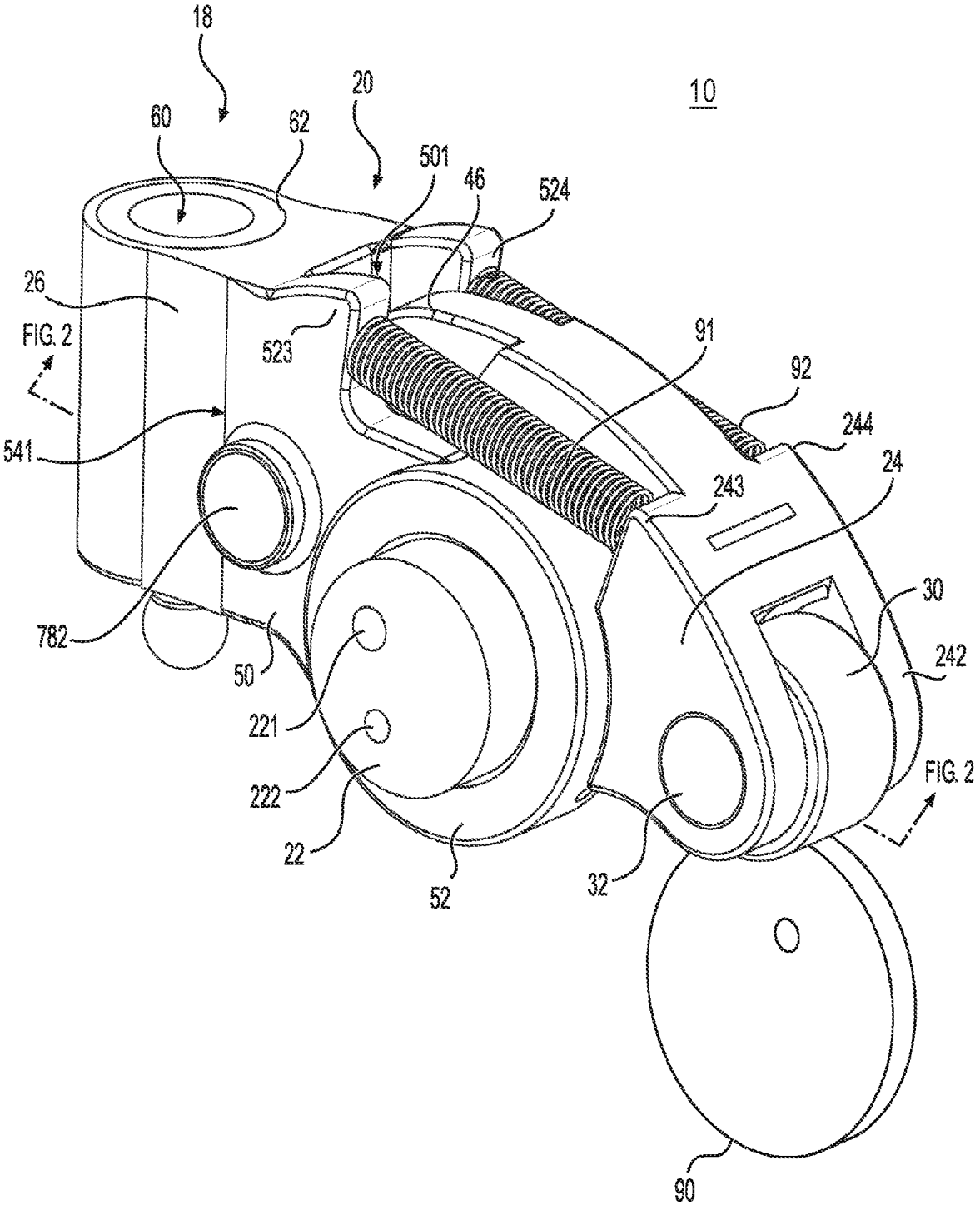
FIG. 1 illustrates a perspective view of an example Type III rocker arm assembly in accordance with the present disclosure.

With initial reference to FIG. 1, a Type III valvetrain arrangement 10 is configured to be positioned on a cylinder block (not shown) of an engine. A rotating cam 90 is shown schematically and rotating cam 90 can impart a valve lift profile to the rocker arm assembly. It will be appreciated that while shown in a Type III arrangement, it is within the scope of the present disclosure for the various features described herein to be used in other arrangements. In this regard, the features described herein associated with the valvetrain arrangement 10 can be suitable to a wide variety of applications. In the example embodiment, the valvetrain arrangement 10 is supported in a carrier (not shown) and each cylinder can include an intake valve rocker arm assembly and an exhaust valve rocker arm assembly 18. The intake valve rocker arm assembly is configured to control motion of intake valves of an associated engine.

Figure 5:
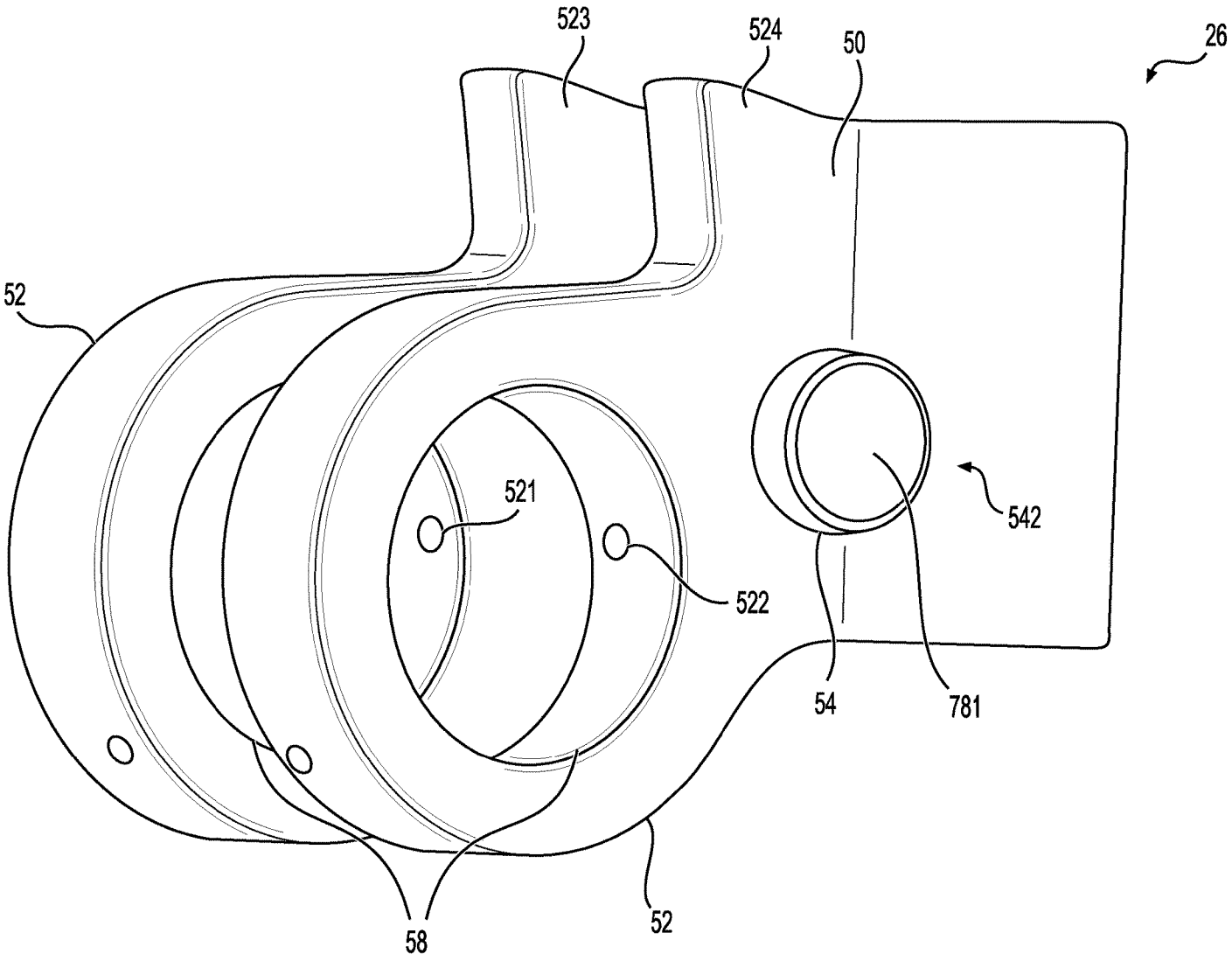
FIG. 5 illustrates a perspective view of the outer arm.
Figure 6A:
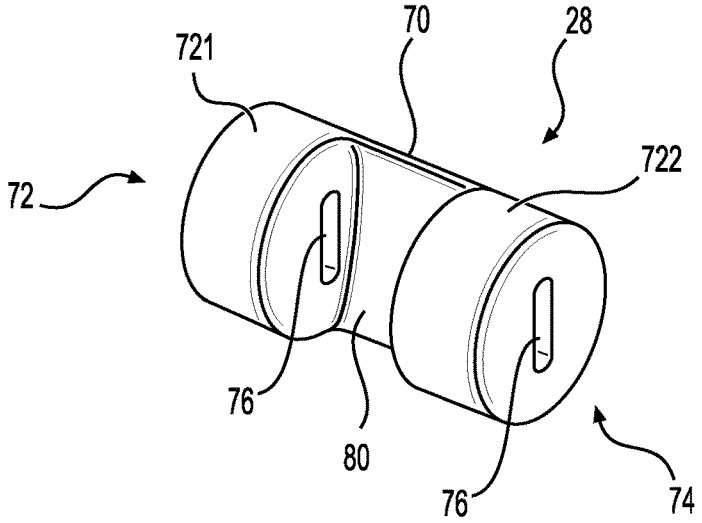
FIGS. 6A & 6B illustrate views of aspects of the latch assembly.
Figure 6B:
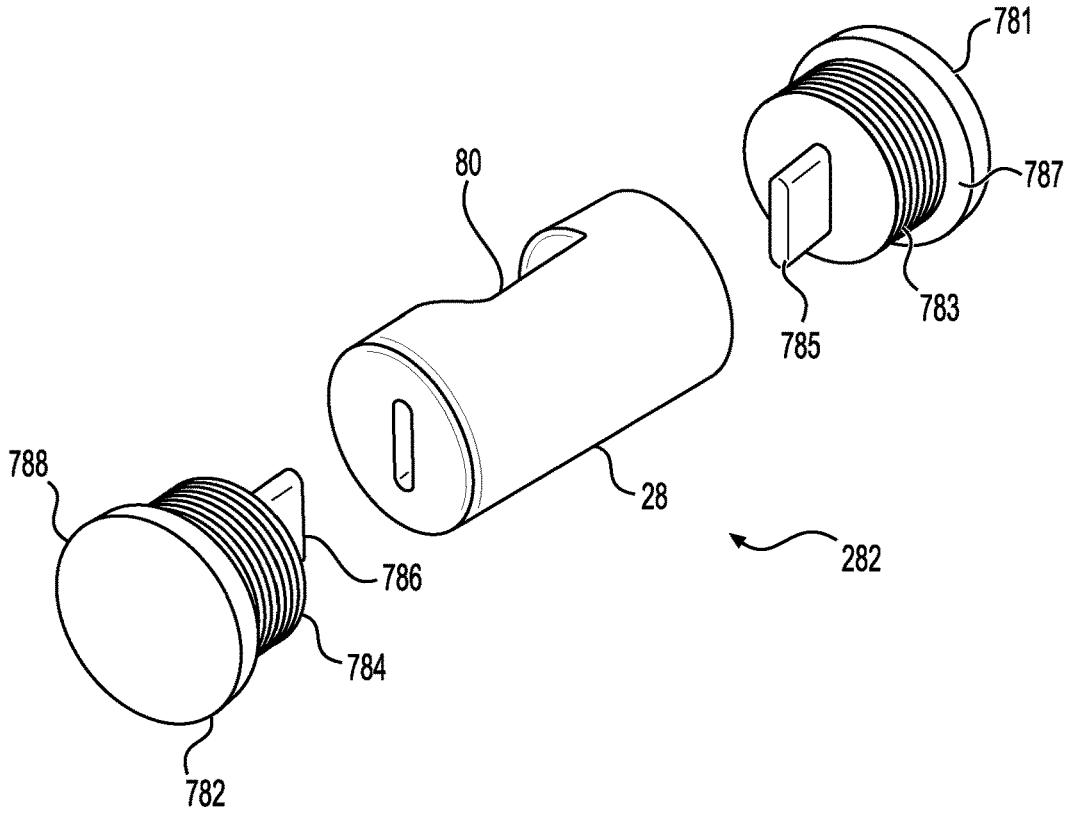

In the example embodiment, the rocker arm assembly 18 generally includes a rocker arm 20 configured to rotate about a rocker shaft 22. The rocker arm 20 generally includes an inner arm 24 (FIG. 4), an outer arm 26 (FIG. 5), and a latch pin 28 (FIGS. 6A & 6B). A roller 30 is rotatably coupled to inner arm 24 by a pivot pin 32. As will be described in greater detail herein, the inner arm 24 rotates around the rocker shaft 22 based on a lift profile of a cam 90 of a camshaft (not shown) contacting the roller 30.

Figure 3A:
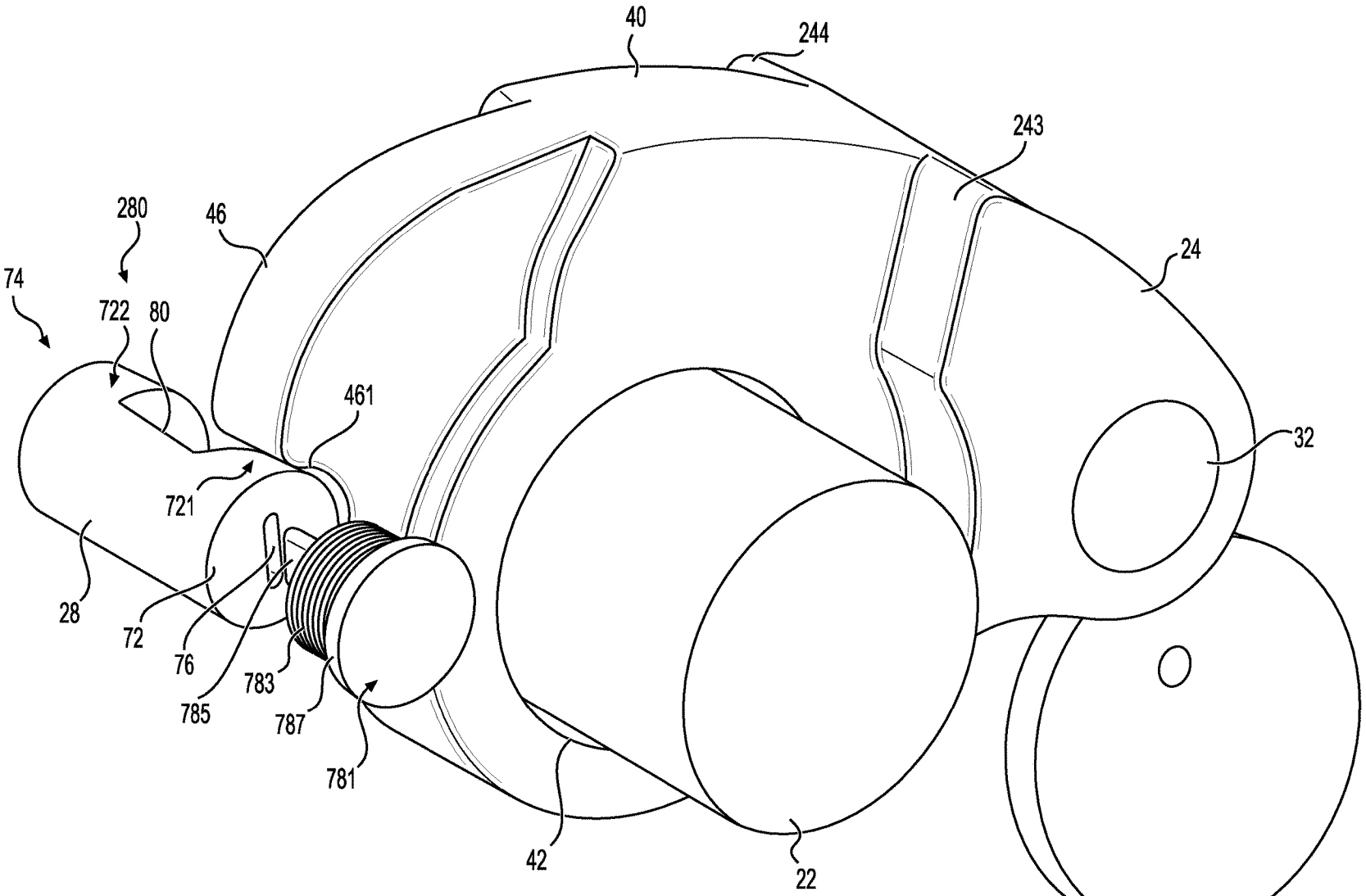
FIGS. 3A & 3B illustrate alternative latch pin positions of the latch assembly relative to a movable inner arm.
Figure 3B:
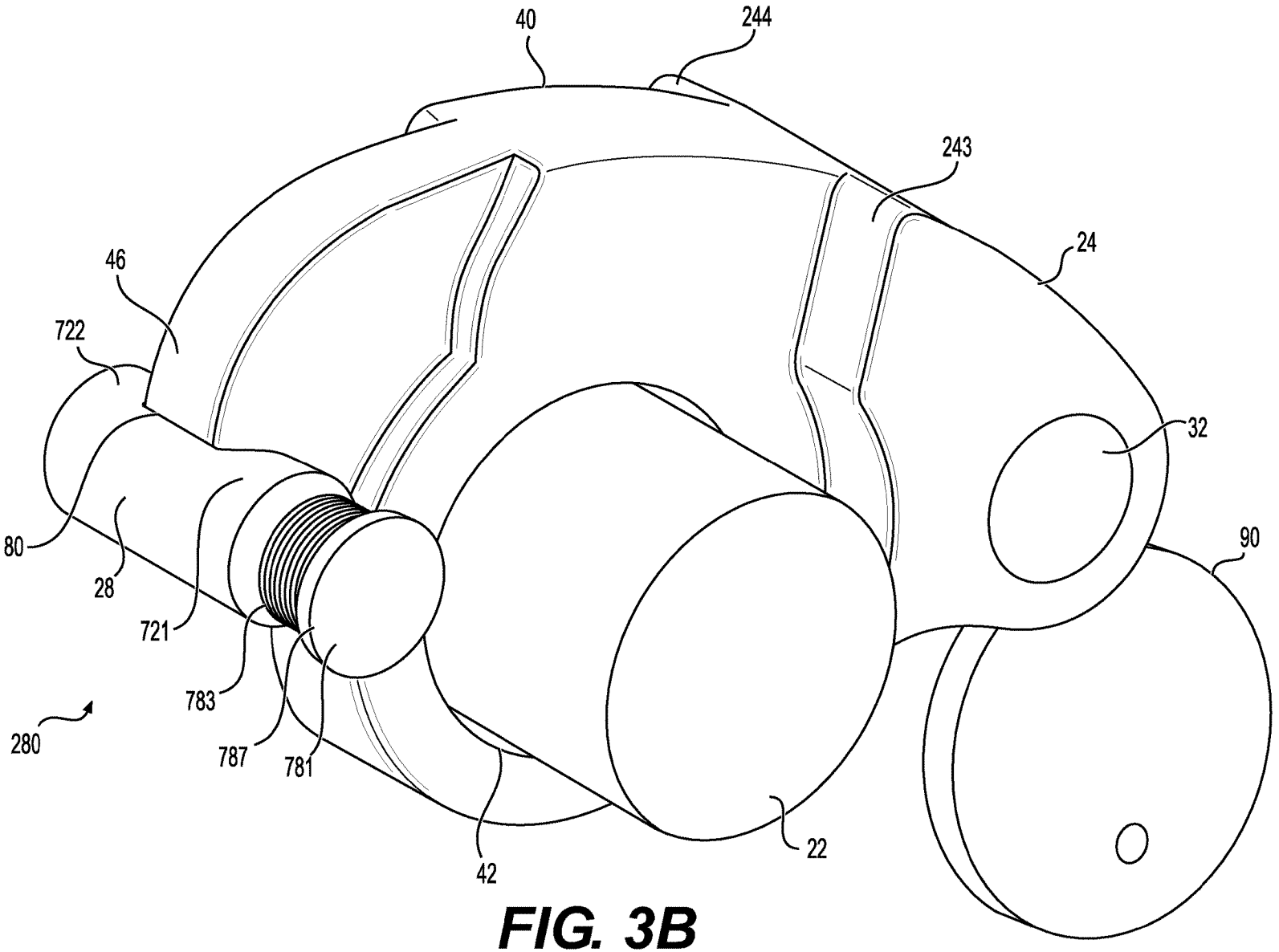
Figure 7:
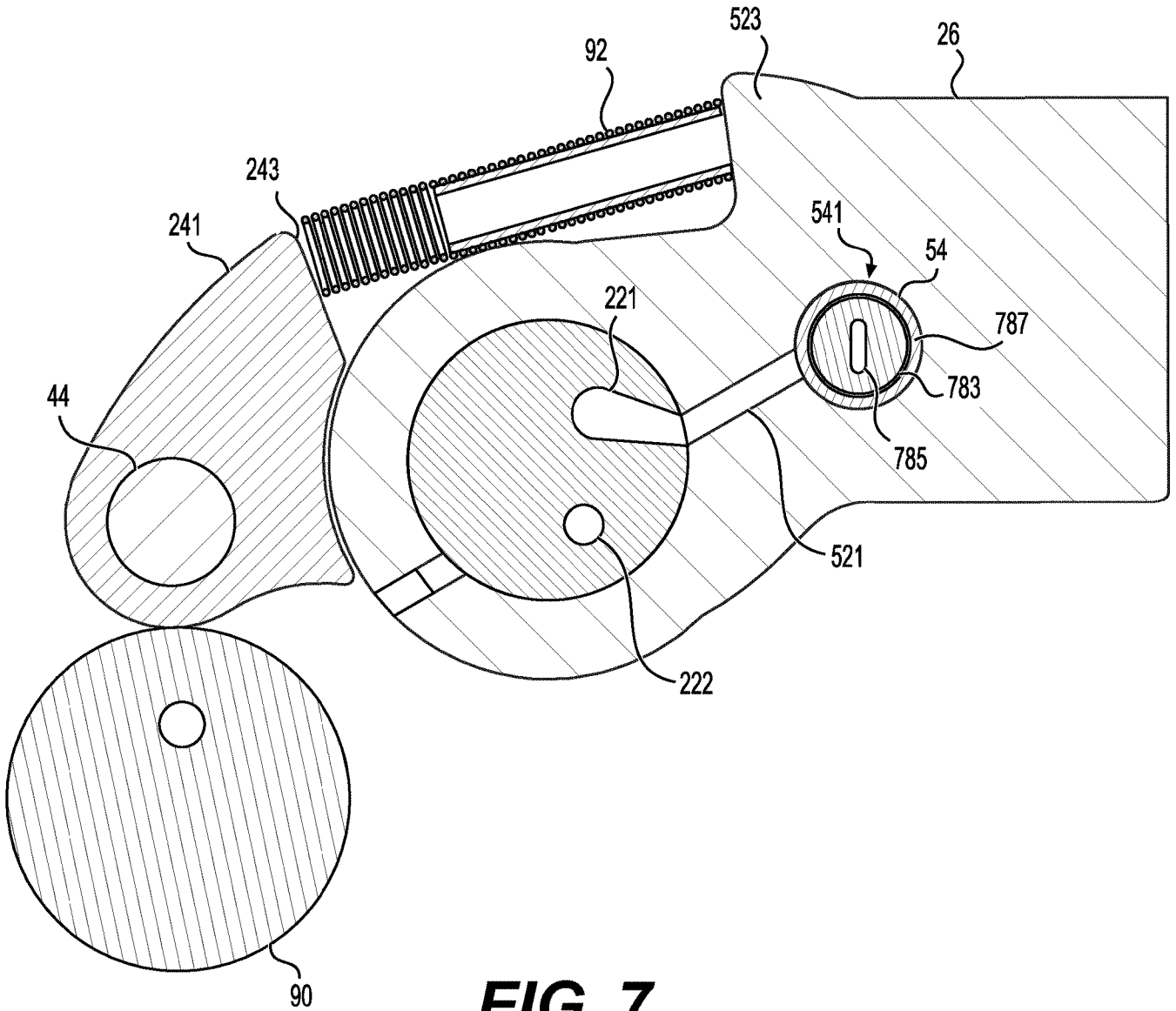
FIG. 7 illustrates a cross-section view of the latch assembly relative to the inner arm, the outer arm, and the rocker shaft.

In the example embodiment, the latch pin 28 is configured to be moved by an actuator. One example of an actuator is shown in FIG. 7. Alternative actuators can comprise, for example, devices to enable hydraulic, pneumatic, electric, mechanical, etc. movement of the latch pin 28 between an activated position (FIG. 3A) and a deactivated position (FIG. 3B). In the activated position, rotational motion of inner arm 24 about rocker shaft 22 is transferred to outer arm 26 via the latch pin 28, thereby causing rotational movement of the outer arm 26 about the rocker shaft 22. In this way, outer arm 26 is configured to transfer motion to another component such as, for example, a valve bridge and/or engine valve. In the deactivated position, rotation of inner arm 24 about rocker shaft 22 does not contact latch pin 28. As such, rotational motion of inner arm 24 is not transferred to outer arm 26.

Figure 4:
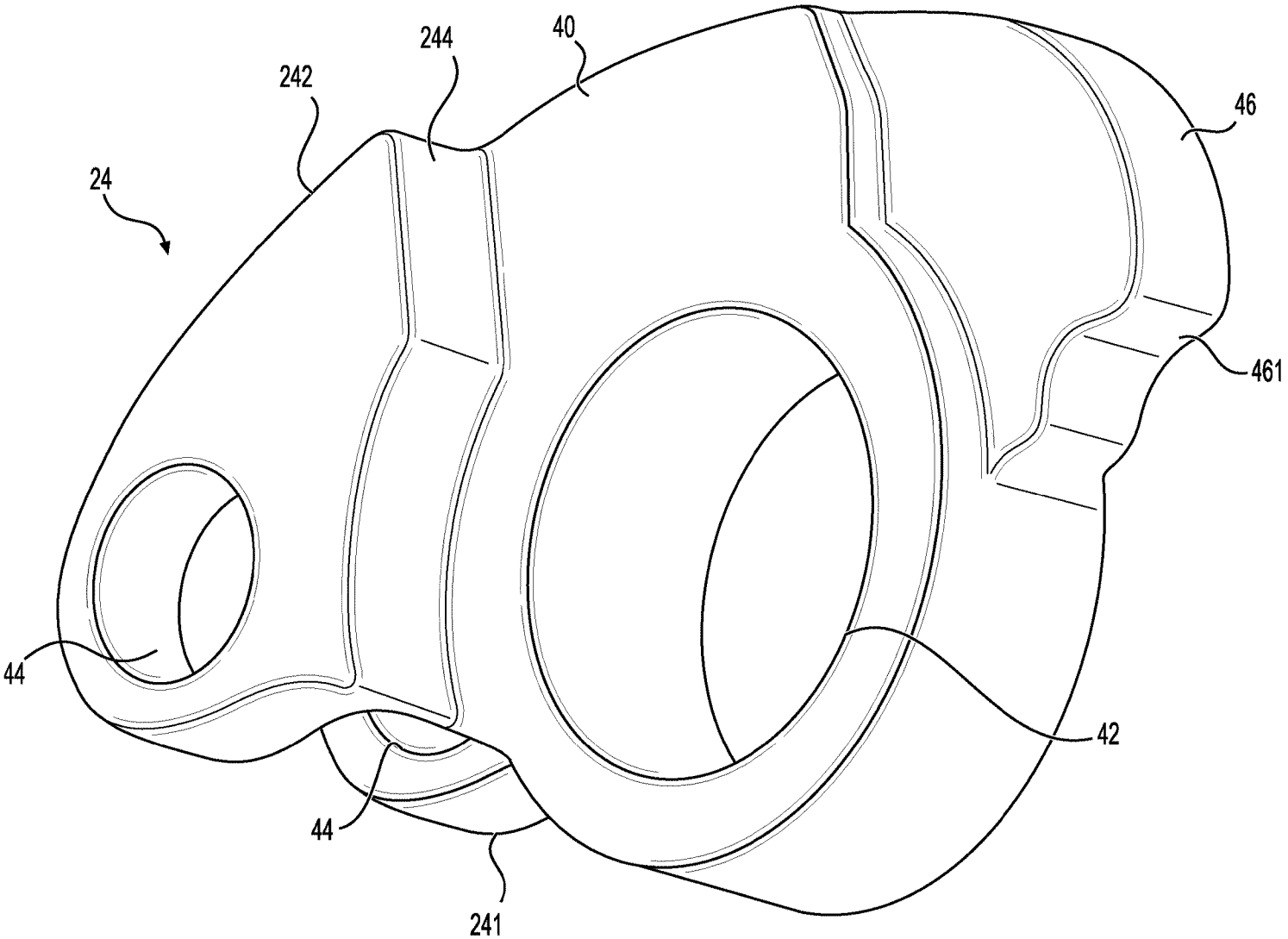
FIG. 4 illustrates a perspective view of the inner arm.

With additional reference to FIG. 4, inner arm 24 will be described in more detail. In the example embodiment, inner arm 24 includes a main body 40 having a first aperture 42, and second aperture 44, and a contact arm 46. The first aperture 42 is configured to receive rocker shaft 22, and the second aperture 44 is configured to receive pivot pin 32. The contact arm 46 is configured to engage the latch pin 28 as by comprising a contact surface 461.

With additional reference to FIG. 5, outer arm 26 will be described in more detail. In the example embodiment, outer arm 26 includes a main body 50 having opposed flanges 52, a latch bore 54, and a capsule bore 62. The opposed flanges 52 are spaced apart from each other to provide clearance for inner arm 24 to be received therebetween. The opposed flanges 52 each define an aperture 58 configured to receive the rocker shaft 22. The latch bore 54 is configured to receive the latch pin 28. The capsule bore 62 is configured to receive a valve actuation capsule or valve actuation component such as, for example, a switchable capsule 60, hydraulic lash adjuster, mechanical lash adjuster, or spigot, among others, configured to engage an e-foot, valve stem, valve bridge, among others.

With additional reference to FIGS. 3A, 3B, 6A, & 6B, latch pin 28 will be described in more detail. In the example embodiment, latch pin 28 includes a generally cylindrical main body 70 having a first end 72 and a second end 74. The latch pin 28 is received within the latch bore 54 in an orientation parallel to or substantially parallel to the rocker shaft 22 and transverse to or substantially transverse to a main (longitudinal) axis of the inner and outer arms 24, 26. Each end 72, 74 includes a keyway such as a through-hole, recess, or slot 76 configured to receive a key 781 (e.g., see FIG. 3A, 6B). The main body 70 defines a clearance 80 for lost motion of the inner arm 24, such clearance comprising a recess, groove, or notch, for example.

In the deactivated position (FIG. 3B), latch pin 28 is moved to a position where contact arm 46 is received within, and can alternatively pass through, the clearance 80. In this configuration, inner arm 24 does not transfer motion to outer arm 26 via latch pin 28. The extent of the motion of the contact arm 46 within the clearance 80 is a function of the lift profile transferred from the cam 90.

In the activated position (FIG. 3A), latch pin 28 is moved to a position where contact arm 46 will contact main body 70 when rotating about rocker shaft 22 to thereby transfer rotational motion to outer arm 26 via the latch pin 28.

Latch assembly 280, 282 can be configured for use in a switchable rocker arm. Latch assembly 280 can comprise a key 781 and a return spring 783 biasing the latch pin 28, while latch assembly 282 can comprise key 781 and second key 782 with the latch pin 28 biased by return springs 783, 784.

Latch assembly 280, 282 can comprise a latch bore 54 formed in a body of material, in this example, in a portion of main body 50 of outer arm 26. Latch bore 54 comprises a first bore end 541, a second bore end 542, and a lost motion gap 501. Lost motion gap 501 can be formed between shoulders 523, 524 extending from the main body 50 of the outer arm 26. Shoulders 523, 524 can seat biasing mechanisms 91, 92. In other rocker arm variations, the lost motion gap 501 can be formed by a notch, groove, divot or other indentation that enables the inner arm 24 to move in lost motion.

Latch pin 28 is configured to reciprocate in the latch bore 54. Latch pin 28 comprises a main body 70, which can be cylindrical. Latch pin 28 comprises a first plug end 72 in the first bore end 541, a second plug end 74 in the second bore end 542, and a clearance 80 between the first plug end 72 and the second plug end 74. The latch pin is configured to selectively move in the latch bore 54 between the activated position and the deactivated position. When the latch pin 28 is in the activated position, one of the first plug end 72 and the second plug end 74 is positioned in the lost motion gap 501. The inner arm 24, in this example, the contact arm 46 and contact surface 461, cannot move in lost motion. The inner arm 24 transfers a lift profile from the cam 90 to the valve end of the outer arm 26. But, when the latch pin 28 is in the deactivated position, the clearance 80 is in the lost motion gap 501. Then, the inner arm can move in lost motion. A lift profile from the cam 90 does not transfer to the valve end of the outer arm 26 because the inner arm moves in the space provided by the clearance 80 and the lost motion gap 501. It is possible, by so designing the cam lobe profile, to have the inner arm 24 move past the latch pin 28 altogether so that it moves from above to below the latch pin 28.

The latch assembly 280 can comprise a key 781 in the latch bore 54. The key 781 can be configured to guide the latch pin 28 in the latch bore 54. The key 781 can comprise a post 785, stake, pin, or other guide. The latch pin 28 can comprise a slot 76 or other keying or clocking feature, such as a tab, d-shape, tooth, or the like. The key 781 can be configured with the post 785 to guide the latch pin 28 via the slot 76. In alternatives, the latch bore 54 can be configured with a mating clocking or keying feature, and the key can be substituted with a plug, cap, blind bore, or other latch bore sealing component. As illustrated, the key 781 comprises a head 787 that can function to press to the latch bore 54. The post 785 extends from the head 787. And, a return spring 783 is coiled around the post 78 and is biased against the head 787 and the first plug end 72 to bias the latch pin 28 in the latch bore 54. The return spring 783 can push the plug body 721 so that it blocks the inner arm 24 from moving in the lost motion gap 501. If a blind bore were placed at the second bore end 542, a hydraulic supply pressure could be controlled to oppose the force of the return spring 783 to push the clearance 80 into alignment with the lost motion gap 501. Hydraulic supply pressure could be supplied via supply port 221 in rocker shaft 22. A second supply port 222 can function as another pressure control conduit, including a return path.

In an alternative, controlling hydraulic supply pressures can be supplied to both ends 541, 542 of the latch bore. Instead of one hydraulic port 521 in the previous example, two hydraulic ports 521, 522 can extend in the flanges 52 and in the main body 50 between the rocker shaft 22 and the latch bore 54 so that oil pressure control can direct the latch pin 28 between the deactivated and activation positions. Hydraulic supply pressure could be supplied via control of the positions of supply ports 221, 222 in rocker shaft 22. It can be said that the latch bore 54 is configured to receive hydraulic control via one or more hydraulic ports 521, 522 in one or both of the first bore end 541 and the second bore end 542 to move the latch pin 28. Having a plug shape to the plug bodies 721, 722 allows pressure to build against the latch pin 28 for oil control. But, with modification to the latch pin 28 and latch bore, other reciprocation control techniques can be achieved.

The latch assembly 282 can comprise a second return spring 784 biased against the second plug end 74. A rim, lip, post, stake, or other spring guide can optionally be included in the latch bore 54. Additionally, and alternative to having a blind bore at the second bore end 542, a through-hole can be used at the second bore end 542. Then, a second key 782 can be pressed to the through-hole to secure the latch pin 28 in the latch bore 54. Second key 782, and its alternatives, can comprise any one of the alternatives that key 781 can comprise, including head 788 & post 786. Second return spring 784 can bias against the second plug end 74 and the head 788 of second key 782.

A rocker arm assembly 18 can comprise an outer arm 26 configured to rotate about a rocker shaft 22. Outer arm 26 can comprise main body 50 defining opposed flanges 52 each defining an aperture (rocker bore) 58 to receive the rocker shaft 22. The outer arm 26 can comprise the latch bore 54. The latch bore 54 can be between the rocker shaft 22 and the valve end. The valve end can comprise a cleat, e-foot, or other structure to couple to a valve or valve bridge, or valve end can comprise a capsule 60 such as a lost motion capsule, engine braking capsule, among others.

Inner arm 24 can be at least partially disposed within the outer arm 26 and can be configured to selectively move within the outer arm 26. While the inner arm 24 is illustrated as rotating about the rocker shaft 22 as by surrounding the rocker shaft 22 with first aperture (rocker bore) 42, other pivot locations can be had, as by including a pivot pin to link the inner arm 24 to the outer arm 26. The inner arm 24 can rotate relative to the rocker shaft 22 via these alternative pivot arrangements.

Figure 2:
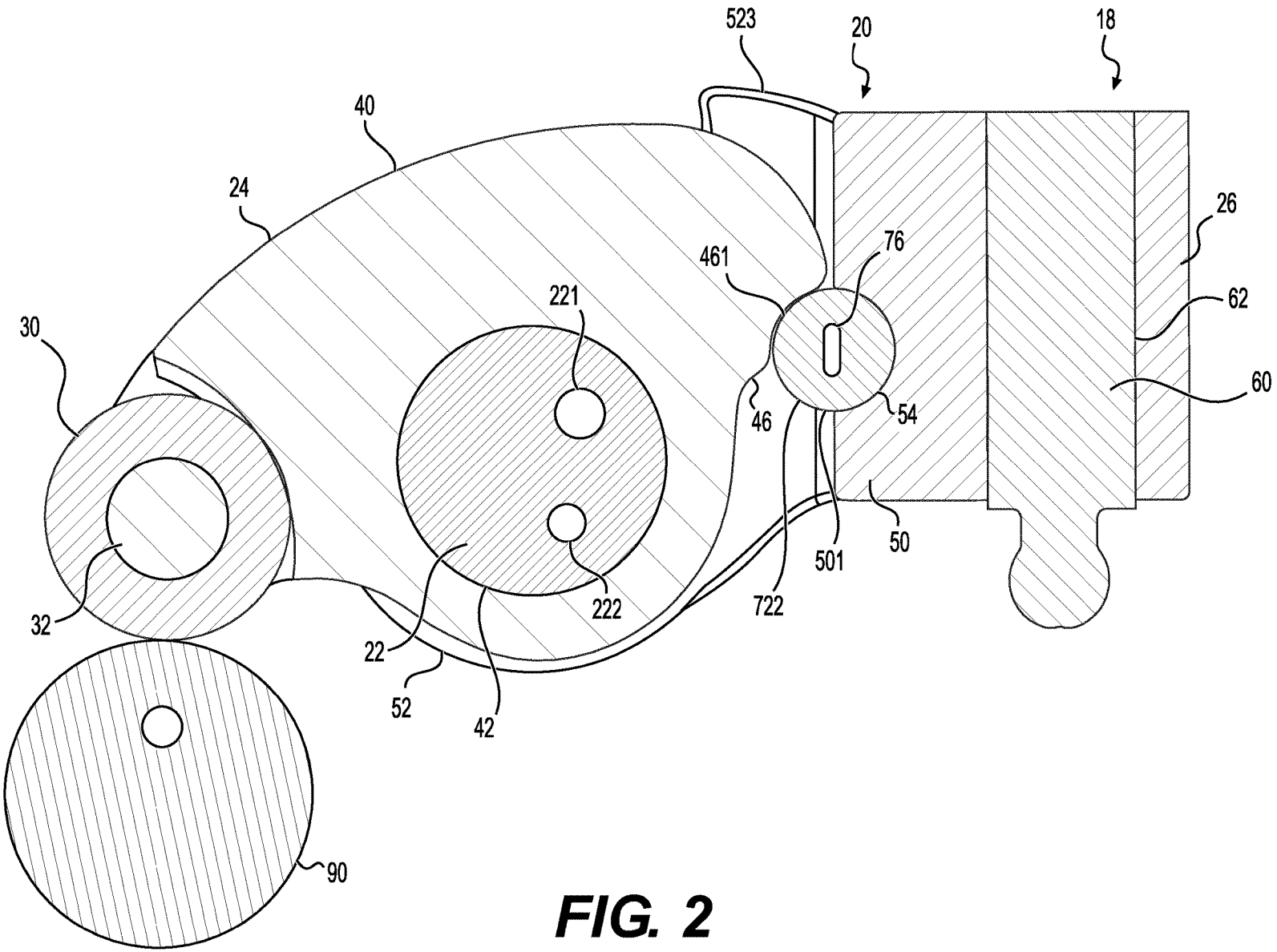
FIG. 2 illustrates a cross-section view of the example Type III rocker arm of FIG. 1.

The latch assembly 280, 282 can be positioned to move between the activated position and the deactivated position, as by reciprocating in the latch bore 54. When the latch pin 28 is in the activated position (FIGS. 2 & 3A), the inner arm 24 is configured to transfer force to the outer arm 26 via the latch pin 28. When the latch pin 28 is in the deactivated position, the inner arm 24 is configured to move in the clearance 80 and in the lost motion gap 501.

The inner arm can comprise a main body 40 defining a first aperture (rocker bore) 42 to receive the rocker shaft 22. A second aperture or pair of apertures 44 can be formed across a forked roller end 241 and can be configured to rotatably support a roller 30. Roller 30 can be seated via a pivot pin 32. Or, roller 30 can be substituted with a tappet. Tappet or roller can be configured to receive a lift profile from cam 90. Inner arm 24 can also comprise a contact arm 46 configured to selectively contact the latch pin 28 when the latch pin is in the activated position. The contact arm 46 can comprise a contoured contact surface 461 to distribute pressure on the latch pin 28.

One or more biasing mechanisms 91, 92 (e.g., springs) can be disposed between the inner arm 24 and the outer arm 26 to bias the inner and outer arms into a desired position relative to each other.

Described herein is a heavy duty Type III rocker arm assembly with cylinder deactivation (CDA). The rocker arm assembly includes an inner arm, outer arm, and latch pin designed for high stiffness and low mass moment of inertia. The design is configured to provide no contact stress singularity issues at edges of the latch pin/rocker arm hole ID due to tangent/throughout contact of the latch pin maintained with the rocker arm hole.

Further, the inner arm, outer arm, and latch pin are designed to reduce tensile stress to provide improved fatigue life. Additional modifications can provide further improvement to assembly stiffness.

The foregoing description of the examples has been provided for purposes of illustration and description. It is not intended to be exhaustive. Alternative rocker arm assemblies comprising arrangements of inner and outer arms can be used with the latch assembly disclosed herein.

What is claimed is:

1. A latch assembly for a switchable rocker arm, the latch assembly comprising:

a latch bore comprising a first bore end, a second bore end, and a lost motion gap;

a latch pin comprising a main body including a first plug end with a first keying feature, a second plug end, and a clearance defined between the first plug end and the second plug end; and a first key arranged at the first bore end, the first key comprising a first mating keying feature configured to mate with the first keying feature so as to guide the latch pin, and a first return spring coupled to the first key so as to bias against the first plug end, wherein the latch pin is configured to selectively reciprocate in the latch bore between:

an activated position in which one of the first plug end and the second plug end is positioned in the lost motion gap, and a deactivated position in which the clearance is in the lost motion gap.

2. The latch assembly of claim 1, wherein the first mating keying feature comprises a post, and wherein the first keying feature comprises a slot.

3. The latch assembly of claim 1, wherein the latch bore is configured to receive hydraulic pressure at the first bore end and/or at the second bore end so as to move the latch pin.

4. The latch assembly of claim 1, further comprising a second key arranged at the second bore end, the second key comprising a second mating keying feature configured to mate with a second keying feature at the second plug end so as to guide the latch pin, and a second return spring coupled to the second key so as to bias against the second plug end.

5. A rocker arm assembly comprising:

an outer arm configured to rotate about a rocker shaft, the outer arm comprising the latch assembly of claim 1; and an inner arm at least partially disposed within the outer arm and configured to selectively move within the outer arm, wherein, when the latch pin is in the activated position, the inner arm is configured to transfer force to the outer arm via the latch pin, and wherein, when the latch pin is in the deactivated position, the inner arm is configured to move through the clearance and through the lost motion gap.

6. The rocker arm assembly of claim 5, wherein the inner arm comprises a main body defining:

a first aperture configured to receive the rocker shaft;

a second aperture configured to rotatably support a roller; and a contact arm configured to selectively contact the latch pin when the latch pin is in the activated position.

7. The rocker arm assembly of claim 6, wherein the roller is configured to receive a lift profile from a cam.

8. The rocker arm assembly of claim 5, wherein the outer arm comprises a main body defining:

opposed flanges each including an aperture configured to receive the rocker shaft;

the latch bore configured to receive the latch pin; and a capsule bore configured to receive a valve actuation capsule.

9. The rocker arm assembly of claim 8, wherein the outer arm further comprises a hydraulic port in at least one of the opposed flanges, the hydraulic port configured to supply an actuation fluid from the rocker shaft to the latch bore.

10. The rocker arm assembly of claim 5, wherein the first bore end comprises a through-hole, wherein the second bore end comprises a blind hole, and wherein the first key is configured to be fitted to the through-hole so as to retain the latch pin in the latch bore.

11. The rocker arm assembly of claim 10, wherein the first keying feature is configured to reciprocate on the first mating keying feature.

12. The rocker arm assembly of claim 5, wherein the first bore end comprises a first through-hole, wherein the second bore end comprises a second through-hole, wherein the first key is fitted to the first through-hole so as to retain the latch pin in the latch bore, and wherein the latch assembly further comprises a second key fitted to the second through-hole so as to retain the latch pin in the latch bore.

13. The rocker arm assembly of claim 12, wherein the first keying feature is configured to reciprocate on the first mating keying feature.

14. The rocker arm assembly of claim 5, wherein the latch assembly further comprises a second key arranged at the second bore end, the second key comprising a second mating keying feature configured to mate with a second keying feature at the second plug end so as to guide the latch pin.

* * * * *